US005337644A

United States Patent [19]

Fishman et al.

[11] Patent Number: 5,337,644

[45] Date of Patent: Aug. 16, 1994

[54] STRINGED MUSICAL INSTRUMENT WITH MULTI-LAMINATE FRETBOARD

[75] Inventors: Lawrence R. Fishman, West Medford, Mass.; Kenneth Parker, Seymour, Conn.

[73] Assignee: Korg/Fishpark Associates, Woburn, Mass.

[21] Appl. No.: 862,975

[22] Filed: Apr. 3, 1992

Related U.S. Application Data

[62] Division of Ser. No. 352,154, May 15, 1989, Pat. No. 5,125,312.

[51] Int. Cl.[5] ..... G10D 3/06; G10D 1/08

[52] U.S. Cl. ..... 84/314 R; 84/293; 84/267

[58] Field of Search ..... 84/730, 731, DIG. 24, 84/291, 293, 314 R, 267

[56] References Cited

U.S. PATENT DOCUMENTS

| | | | |
|---|---|---|---|
| 3,396,284 | 8/1968 | Scherer | 84/731 |
| 4,290,336 | 9/1981 | Peavey | 84/291 |
| 4,308,784 | 1/1982 | Eizonas | 84/314 N |
| 4,334,452 | 6/1982 | Morrison, III et al. | 84/291 |
| 4,408,516 | 10/1983 | John | 84/291 |
| 4,491,051 | 1/1985 | Barcus | 84/DIG. 24 |
| 4,633,754 | 1/1987 | Chapman | 84/314 R |
| 4,727,634 | 3/1988 | Fishman | 84/DIG. 24 |
| 4,748,887 | 6/1988 | Marshall | 84/291 |
| 4,873,907 | 10/1989 | Deeker, Jr. et al. | 84/291 |
| 4,951,542 | 8/1990 | Chen | 84/293 |

*Primary Examiner*—Michael L. Gellner
*Assistant Examiner*—Cassandra C. Spyrou
*Attorney, Agent, or Firm*—Wolf, Greenfield & Sacks

[57] ABSTRACT

A light weight guitar construction and associated method of manufacture involves the use of a light weight wood core material having deposited thereover a strengthening layer preferably of carbon fiber and a fiberglass sheet layer both impregnated with a high temperature resin. A piezoelectric crystal transducer system is used individually with each string for sensing string vibrations. An improved fret board construction is employed. In one feature of the present invention each of the frets have coupled thereto circuit runs for signal coupling.

18 Claims, 10 Drawing Sheets

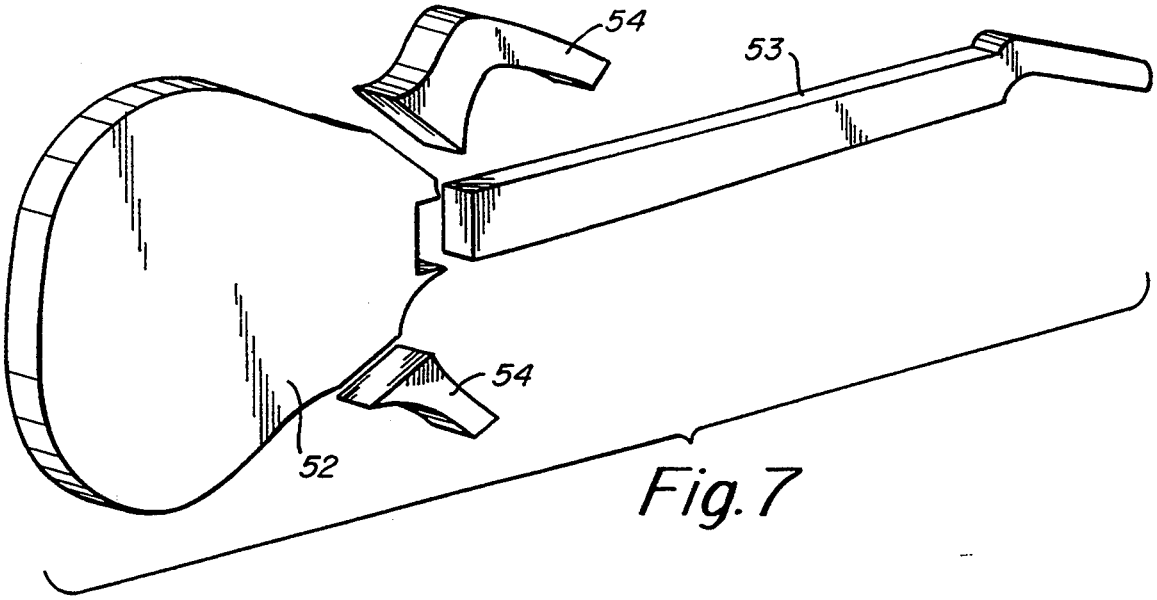
Fig. 7
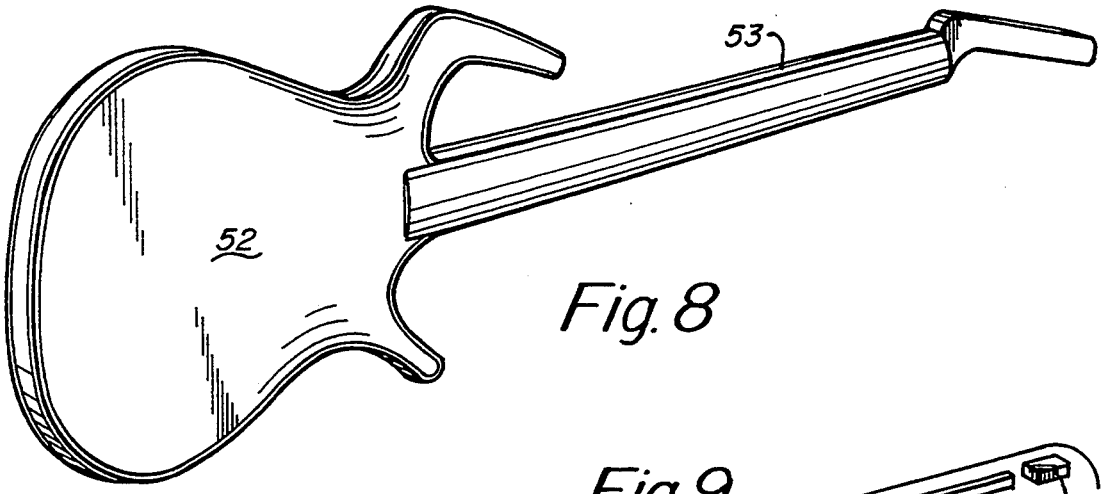
Fig. 8
Fig. 9
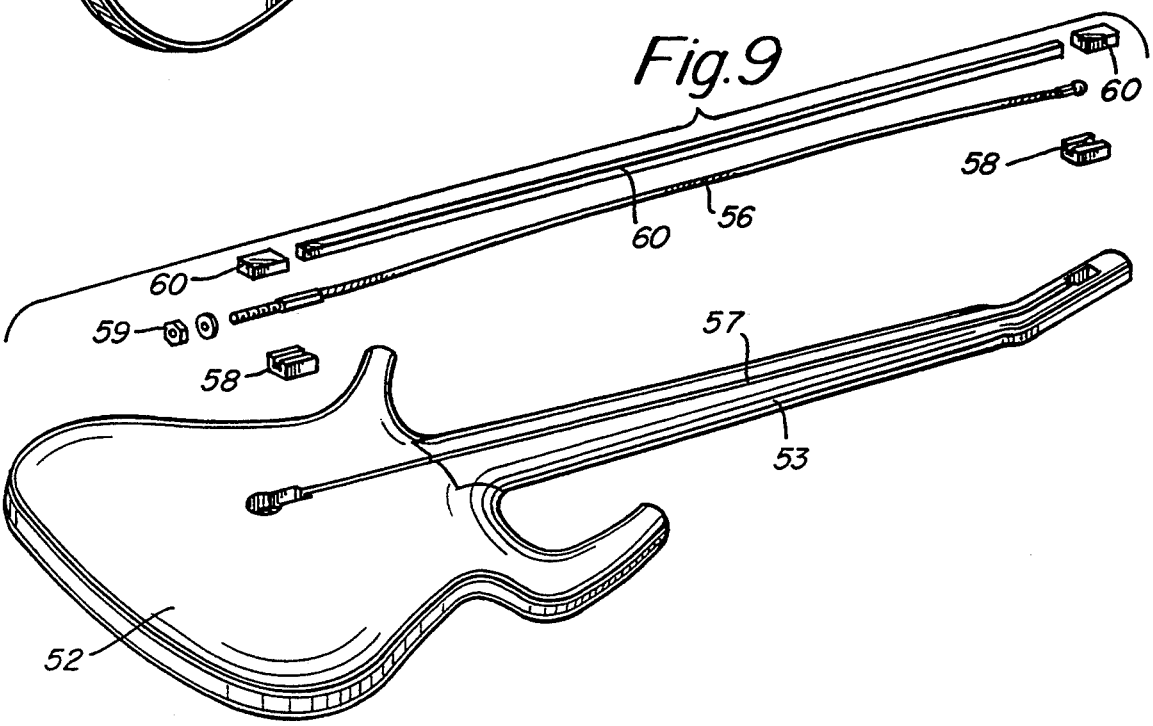

STRINGED MUSICAL INSTRUMENT WITH MULTI-LAMINATE FRETBOARD

This application is a division of application Ser. No. 07/352,154, filed May 15, 1989 now U.S. Pat. No. 5,125,312.

BACKGROUND OF THE INVENTION

1. Field of the Invention

The present invention relates in general to stringed musical instruments, and pertains more particularly, to an improved light-weight stringed instrument, particularly a light-weight guitar. Moreover, the present invention relates to the construction and associated method of fabrication of a light-weight stringed musical instrument. Furthermore, the present invention is directed to improved transducer systems for stringed musical instruments.

2. Background Discussion

Although attempts have been made at constructing light-weight musical instruments, particularly light-weight guitars, these efforts have not been totally successful, particularly in constructing guitars of weights on the order of 5 pounds or less. Fabrication techniques have tended to be complex and time consuming and in some instances the costs have been prohibitive. Also, similar problems are encountered in connection with transducers for such stringed instruments. They have tended to be complex, cumbersome, difficult to fabricate and relatively costly.

Accordingly, it is an object of the present invention to provide an improved, and in particular a light-weight, stringed musical instrument. The construction of the present invention is in particular adapted for fabrication of guitars.

Another object of the present invention is to provide a method of fabrication of stringed musical instruments. This method of manufacture is also adapted to in particular provide for the construction of a light-weight instrument.

A further object of the present invention is to provide an improved transducer system for use with stringed musical instruments and in particular for use in conjunction with the fabrication of a light-weight guitar.

Still another object of the present invention is to provide an improved piezoelectric-type transducer for stringed musical instruments, and one that is in particular of simple and light-weight construction while at the same time having substantially improved response.

Still another object of the present invention is to provide an improved fret construction for a stringed musical instrument.

Another object of the present invention is to provide an improved neck construction for a stringed musical instrument, and one in which signal coupling is attainable from individual frets supported on the neck.

SUMMARY OF THE INVENTION

To accomplish the foregoing and other objects, features and advantages of the invention there is provided, in accordance with one feature of the present invention, a method of fabricating a light-weight musical instrument such as a guitar. The instrument is fabricated using a wood instrument core preferably of a light-weight soft-wood that forms at least the body of the instrument. Disposed over the body is a strengthening layer and a finish layer. These are formed as a laminate to the outer surface of the wood instrument core. The strengthening layer may be provided by a thin layer of carbon fiber while the finish layer may be provided by a thin layer of a fiberglass sheet. Preferably a high temperature resin material is employed in the laminate. Heat is applied to cure the layers in forming the instrument. Heat may be applied while subjecting the instrument to vacuum by disposing the instrument in a vacuum bag.

In accordance with another feature of the present invention there is provided a musical instrument transducer system for a stringed musical instrument such as a guitar. This transducer system comprises a piezoelectric crystal member having oppositely disposed electrodes and a cap member that is adapted to be in contact with one of the electrodes and has means for receiving a string supported thereat and for coupling of string vibrations to the crystal member. A metallic support member is disposed in contact with and for support of the other electrode. A dielectric base member holds the metallic support member. Lead means may couple to the cap member and the metallic support member. The crystal member is preferably a thin piezoelectric disk. The metallic member preferably has a terminal post extending through a hole in the dielectric base member. Preferably both the metallic support member and the cap member have respective recesses for receiving the piezoelectric crystal member. The transducer system is employed in combination with a holder. The holder has means for receiving the transducer system and means for attachment to the instrument.

In accordance with still a further feature of the present invention there is provided a method of constructing a fret board of stringed musical instrument. This method includes constructing the fingerboard of the instrument by fabricating a laminate of a carbon fiber layer and fiberglass layer. This laminate is formed into a rigid laminate board. A plurality of separate hard metal frets are employed. These are preferably stainless steel frets. The frets are formed into a configuration matching the surface configuration of the laminate board. The frets are then adhesively secured to the rigid laminate board. In a preferred embodiment of the invention both the laminate board and the frets are formed with an arched surface. The laminate board may have roughened surface strips over which the respective frets are disposed. This assists in adhesively applying the frets.

In accordance with still another feature of the present invention, there is provide a light-weight stringed musical instrument that is comprised of a wood base forming the body and neck of the instrument and a laminate comprised of a strengthening layer and an outer finish layer. As part of the laminate there is furthermore provided a circuit board layer. A plurality of metal frets are disposed on the fingerboard. The circuit board layer is comprised of a plurality of circuit runs corresponding to and for electrically connecting to the plurality of frets, respectively. The circuit board layer is disposed under the laminate. The strengthening layer may be a layer of carbon fiber while the finish layer may be a thin layer of fiberglass sheet. The instrument body and neck preferably also have an elongated recess with a wire cable extending through the recess and having tension adjustment means associated therewith.

BRIEF DESCRIPTION OF THE DRAWINGS

Numerous other objects, features and advantages of the invention should now become apparent upon a reading of the following detailed description taken in conjunction with the accompanying drawings, in which:

FIG. 7 is a perspective view showing the wood core of the instrument in an embodiment is which the components are fabricated separately and then assembled;

FIG. 8 is a perspective view of the sculptured wood parts having been glued back together;

FIG. 9 is a perspective view of the rear surface of the guitar, furthermore illustrating the tensioning cable employed in accordance with the invention;

DETAILED DESCRIPTION

Reference is now made to the drawings herein for an illustration of several features of the present invention including improvements in the construction of the stringed instrument itself, particular to make the instrument light in weight, as well as improvements pertaining to the transducer system employed and the fret board.

Figure 1:
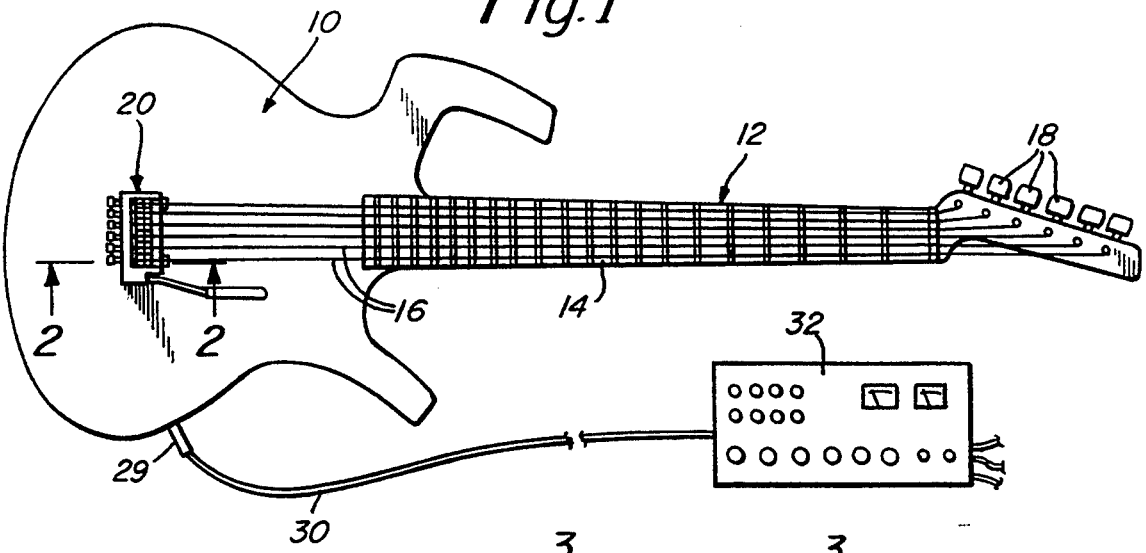
FIG. 1 is a plan view of a guitar constructed in accordance with the principles of the present invention and also illustrating the transducer system mounted thereto.

FIG. 1 illustrates a guitar constructed in accordance with the features of the present invention including an instrument body 10 and a neck 12 supporting a fret board 14. FIG. 1 also illustrates the strings 16 supported respectively at the neck and body. At the neck end, the strings 16 may be supported in a conventional fashion. In this regard adjusting pegs or the like are illustrated at 18.

FIG. 1 also illustrates the strings 16, supported at their body end at the bridge mechanism 20. String adjustment may also be provided at the bridge mechanism 20. Further details of the bridge mechanism, including a description of the transducer system are now detailed in FIG. 2.

Figure 2:
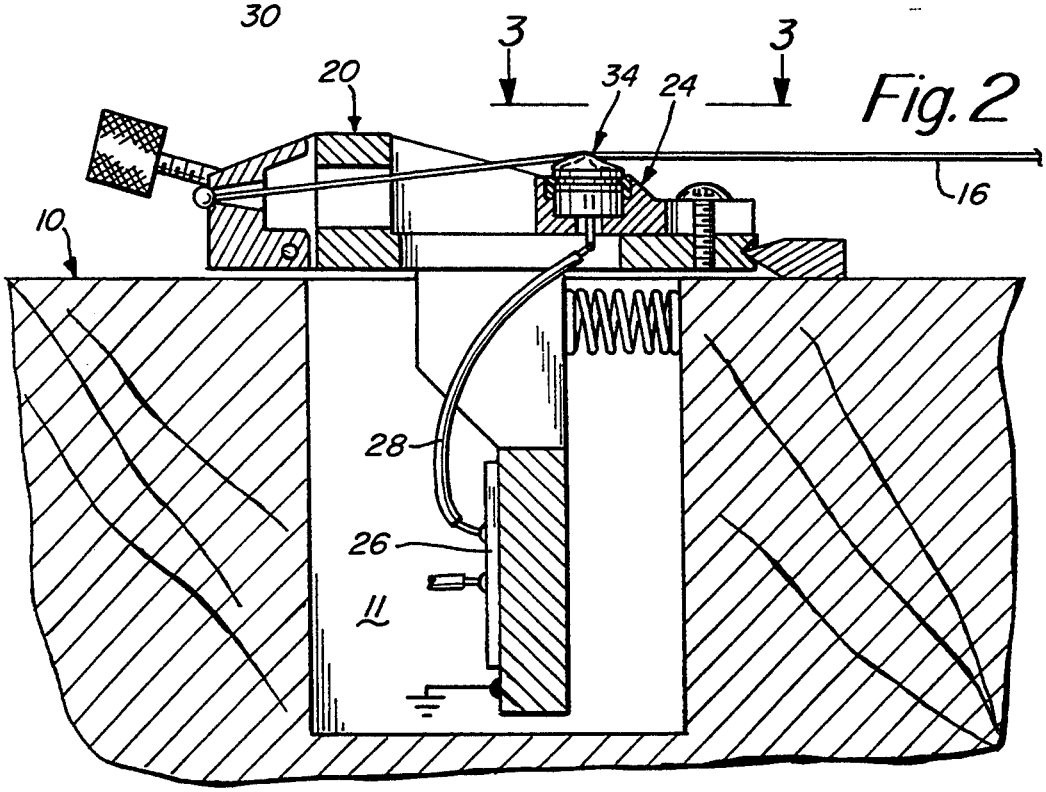
FIG. 2 is a fragmentary cross-sectional view showing further details of the transducer a system employed on the instrument.
Figure 3:
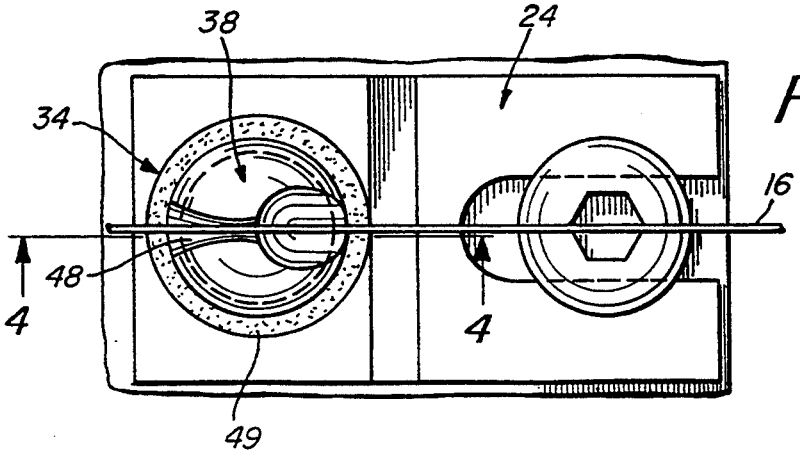
FIG. 3 is a cross-sectional view taken along line 3—3 of FIG. 2.

In FIGS. 1–3, the bridge mechanism 20 is illustrated as a tremelo bridge, however, the bridge mechanism may also be a fixed bridge type. As illustrated in FIG. 2, the bridge mechanism 20 is partially received in a cavity 11 in the instrument body. For further details of parts of the bridge mechanism refer to co-pending application Ser. No. 07/144,322, filed Jan. 14, 1988 now U.S. Pat. No. 4,911,057.

The bridge mechanism 20 is comprised of a holder 24 which in a fixed bridged construction would be held in a fixed position, although one might be adjustable. The bridge mechanism 20 also supports a circuit board 26 supported in the cavity 11. In this connection, it is noted that in FIG. 3 a lead wire 28 is illustrated connecting from the piezoelectric transducer to the circuit board 26. Also, reference may be made to FIG. 1 illustrating a jack 29 and cable 30 connecting to the electronic device 32 which may an amplifier or synthesizer. On the inside of the guitar, the circuit board 26 may have lines coupling to the jack 29. In this way signals from the piezoelectric crystals can be coupled by way of the cable 30 to the device 32.

Figure 4:
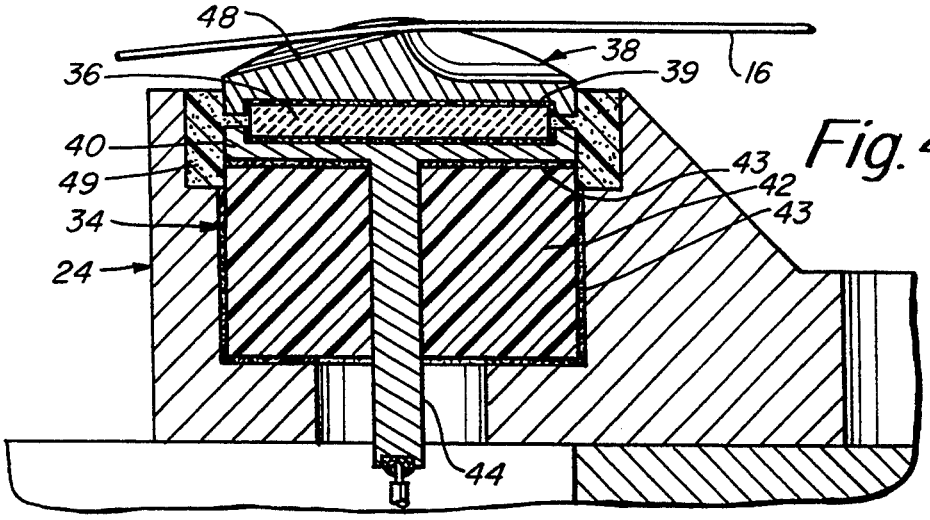
FIG. 4 is a further detailed drawing in a cross-sectional view taken along line 4—4 of FIG. 3 and showing further details of the transducer construction.
Figure 5:
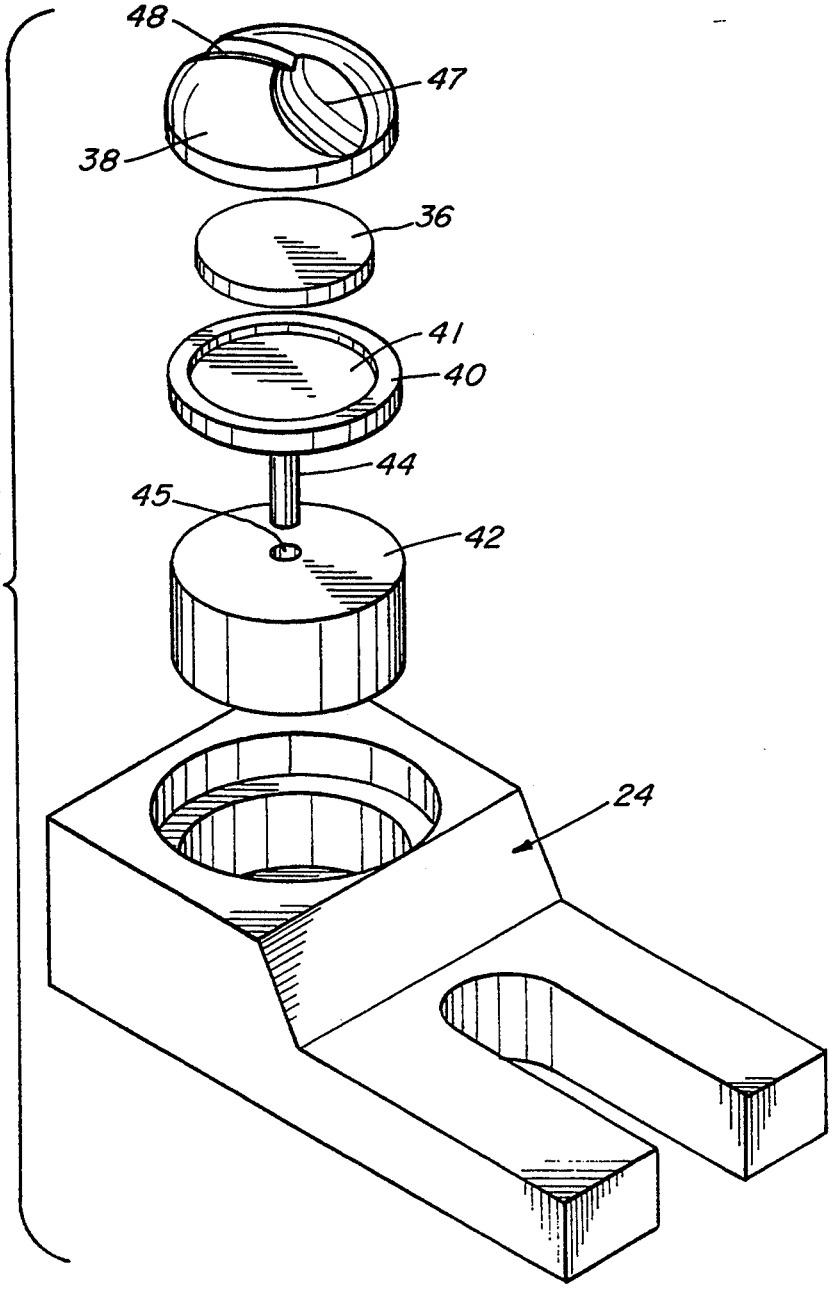
FIG. 5 is an exploded perspective view of the components of the transducer illustrated in FIGS. 2–4.

FIGS. 2 and 3 illustrate the transducer assembly 34 secured in the holder 24. Regarding the transducer assembly 34, reference is also made to FIGS. 4 and 5. FIG. 4 is a cross-sectional view giving further details of the components of the transducer assembly. FIG. 5 is a perspective exploded view of these same components.

The transducer assembly 34 is comprised of a thin piezoelectric disk 36, a cap member 38, a metallic member 40, and a dielectric member 42. The facing surfaces of the cap member and metallic support member have recesses such as the recess 41 illustrated in FIG. 5. These recesses partially accommodate the piezoelectric disk 36. The metallic support member 40 has a terminal post 44 that is adapted to pass through the hole 45 in the dielectric base member 42. FIG. 5 shows the terminal post 44 and the through hole 45. The cross-sectional view of FIG. 4 shows the terminal post 44 extending downwardly below the bottom surface of the dielectric base member 42. A lead wire is soldered to the bottom end of the terminal post 44 as illustrated in FIG. 4.

The cap member 38 is of generally domed construction such as illustrated in FIGS. 4 or 5. Within the domed cap member there is provided a recess 47 that is contiguous with a slot 48. The musical string 16, such as illustrated in FIG. 3, is disposed in the slot 48.

To secure the piezoelectric crystal 36 in place between the cap member 38 and the support member 40, a conductive adhesive may be applied, such as illustrated at 39 in FIG. 4. This provides electrical conductivity from the oppositely disposed upper and lower electrodes of the piezoelectric crystal to the respective cap member and metallic support member. In the embodiment of FIG. 4, the conductivity from the cap member 38 is coupled by way of the metallic string 16 to other metallic parts of the guitar which may be considered as functioning as a ground. Non-conductive dielectric bonding may be provided as illustrated in FIG. 4 at 43. This provides securing between the metallic support member 40 and the dielectric member 42 as well as between the dielectric member 42 and the holder 24. There is also preferably provided a dielectric potting compound 49 disposed essentially about the transducer assembly.

In the transducer assembly, the cap member 38 is preferably constructed of a hard metal material such as of stainless steel. The piezoelectric disk is of a piezoelectric crystal material. The metallic support member may be constructed of a softer metal material such as of brass. The adhesive materials may be epoxy adhesives, either conductive or non-conductive as previously described.

In one prior transducer construction, such as that illustrated in U.S. Pat. No. 4,774,867 the piezoelectric has been bonded essentially only on one surface so as to increase output voltage. However, for this particular application as illustrated herein, it is preferred to have the crystal bonded on both upper and lower faces. This is provided by the conductive epoxy at 39 in FIG. 4. This bonding on both surfaces provides a more accurate output signal, better representative of the true mechanical string vibration. By essentially clamping both sides of the crystal a lower output voltage is provided. This means that the crystal is less sensitive to the compressive mode but is more sensitive to the rotational shear mode. This thus gives a better replication of the true mechanical string vibration. In this regard, the hardness of the potting compound 49 is instrumental and can be controlled so as to provide an accurate replication of the desired string vibration signal.

The potting compound 49, in particular allows one to tune the shear mode. This controls the level of lateral clamping. The amount of clamping relates to the durometer hardness of the potting compound that is employed.

The piezoelectric type of transducer of the present invention is in particular an improvement over previously used magnetic transducers. These magnetic transducers, inter alia, are generally more cumbersome and require the use of ferrous strings. The piezoelectric transducer is more readily tunable and is in particular constructed to desensitize the compressional mode. As such, the transducer is constructed so as to not be that responsive to mechanical vibrations particularly those from the instrument body.

Figure 28:
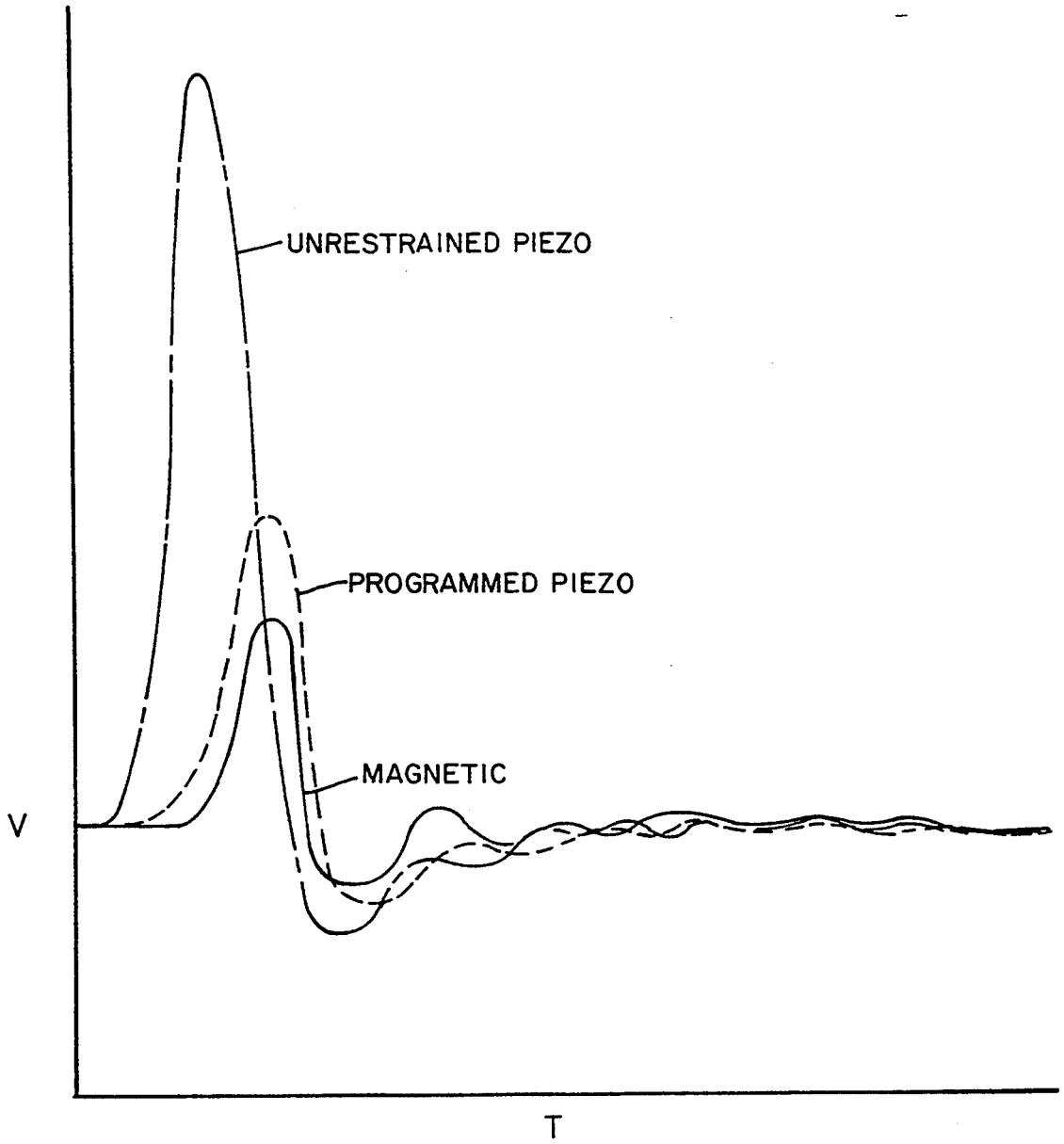
FIG. 28 is a graph relating to the transducer system described herein.

In accordance with further features of the piezoelectric-type transducer, it is noted that with a transducer of this type one can electronically add resonance to replicate a magnetic transducer. In this way a wide variety of sounds can be provided with piezoelectric transducers. Also, the piezoelectric type of transducer does not have to be used with ferrous strings but can be used with any type of string material. Refer also to FIG. 28.

Thus, in accordance with the invention, one of the advantages of the particular transducer employed is that it more accurately replicates actual string action. The device is more sensitive to rotational string forces and is essentially desensitized to compressional mode forces. This is carried out to a great extent by employing a relatively thin piezoelectric crystal material and having bonding on both opposed surfaces thereof. This makes the transducer sensitive primarily to rotational energy in parted to it by the string at its witness point.

Figure 6:
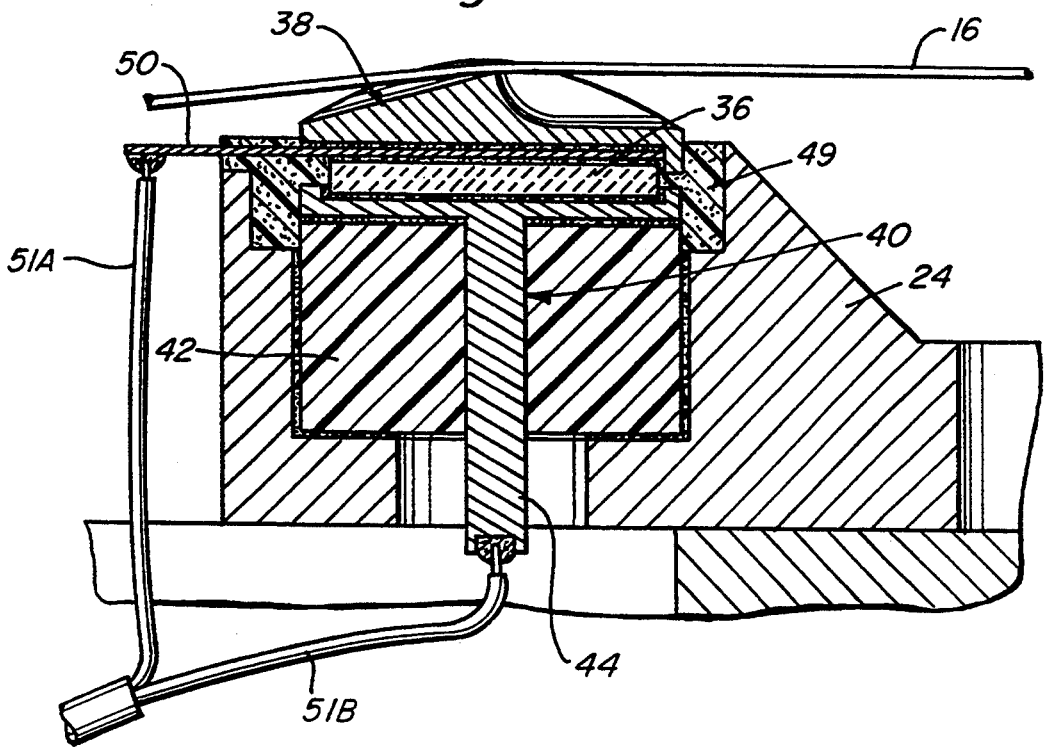
FIG. 6 is a cross-sectional view similar to the cross-sectional view of FIG. 4 but for an alternate embodiment of the transducer.

In FIG. 4 there has been described a transducer assembly in which the grounding of the transducer is through the string 16. Thus, if the string breaks then the ground path is interrupted. As this may be of concern, an embodiment of the invention such as illustrated in FIG. 6 may then be employed. In FIG. 6 the same reference characters are used to identify like parts previously described in connection with FIG. 4. There is thus provided a transducer assembly that is comprised of a cap member 38, a metallic support member 40, a dielectric member 42 and a piezoelectric disk 36. These components are mounted in substantially the same way as described in FIG. 4. A conductive epoxy adhesive is used for securing the piezoelectric disk. Between the top surface of the piezoelectric disk and cap member 38 there is provided a conductive leaf 50, as illustrated in FIG. 6. This leaf extends outwardly and, as illustrated in FIG. 6, leads 51A and 51B solder-connect respectively to the leaf 50 and the terminal post 44. In an alternate arrangement, in place of the solder-connections illustrated in FIG. 6, particularly at the terminal post body 4, a push on connector may be provided in place of the solder thus making the assembly as well as the device cheaper and simplified construction. With the arrangement of FIG. 6, should the string 16 break then there is still ground conductivity by way of the lead 51A.

Reference is now made to FIGS. 7-12 for further details relating to the construction of the guitar of the present invention. In this regard, FIG. 7 shows the basic wood core materials including a body 52, a neck 53 and arms 54. The body 52 and the arms 54 may be cut from say 1½ inch thick redwood material. The neck 53 may be cut from say 1 inch Douglas fir material.

In accordance with a preferred embodiment of the present invention the basic wood core materials are not hard wood materials but are instead soft wood materials. The soft wood materials are lighter in weight and are more well balanced tonally. They are also cheaper, easier to cut and shape, and dimensionally stable. However, with this soft wood core, in accordance with the present invention, rigidity and strength is provided with the special laminate construction of the present invention, in combination with a stiffening or tensioning cable that is employed in the preferred embodiment of the instrument of the present invention.

As will be described in further details hereinafter, the wood core both at the body and neck is covered with a strengthening layer which in the preferred embodiment herein is a carbon fiber (unidirectional) layer, followed by a fiberglass sheet layer to give strength and stability. For bonding a high temperature epoxy resin is used to soak the wood surface and bond the laminate. The use of high temperature epoxy, unlike a room temperature epoxy is advantageous in that the resin provides a crisp, hard characteristic which is important in providing the proper guitar sound.

Reference is now made to the perspective view of FIG. 9 for an illustration of a further feature of the present invention. This involves the use of a hard metal cable such as a stainless steel cable 56. In guitars in the past, metal rods have been employed. However, the flexible cable 56 is preferred as it is generally lighter in weight and is flexible. The cable 56 is adapted to be received in an elongated recess 57 extending along the neck and into the body as illustrated in FIG. 9. Also employed are a pair of anti-rotation pieces 58, one used at each end of the cable 56. A nut 59 is illustrated for tightening and controlling the tension applied by the cable 56. FIG. 9 also shows the use of filler pieces 60 which would be disposed over the cable and anti-rotation pieces to complete the filling of recess 57.

It is noted in FIG. 9 that the recess 57 is provided in the back side of the guitar. In an alternate embodiment of the invention the cable may be secured from the opposite side, such as from the front side of the guitar in which case the recess would be provided in the front surface.

As just indicated, the cable 56 is preferably installed from the back of the instrument. In this way the cable adjusts from the back of the instrument thereby providing a clean appearance from the front. The cable can be positioned very close to the back surface of the instrument where it has the most mechanical advantage. The cable adjusts in a place that is convenient in that there is no need to loosen strings or otherwise disturb the instrument to provide this adjustment. Also, because of the flexible cable used, rather than a stiff rod, the adjustment may be carried out nearly anywhere on the instrument. For example, the adjustment can be at the neck end of the cable rather than at the body end.

Figure 10:
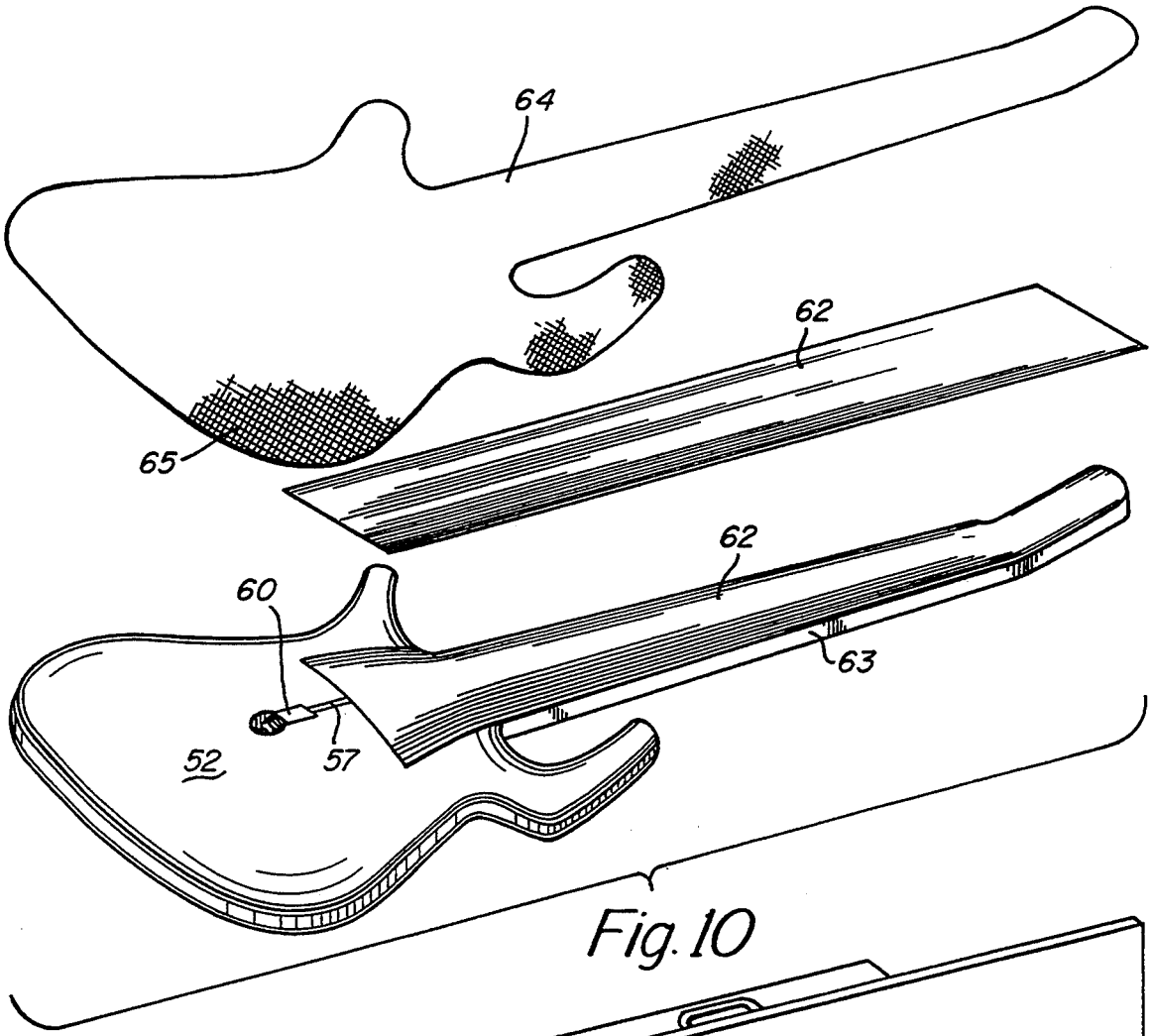
FIG. 10 is an exploded view illustrating the various components employed in fabricating the guitar including carbon fiber and fiberglass layers.

Reference is now made to FIG. 10 for an illustration of the next step in the fabrication of the light-weight guitar of the present invention. The body of the guitar has been contoured to the desired configuration. The neck is properly secured by gluing to the body, preferably using a high temperature epoxy. The glue joints may be angled to facilitate the shaping of the guitar without undo waste of material.

Figure 13:
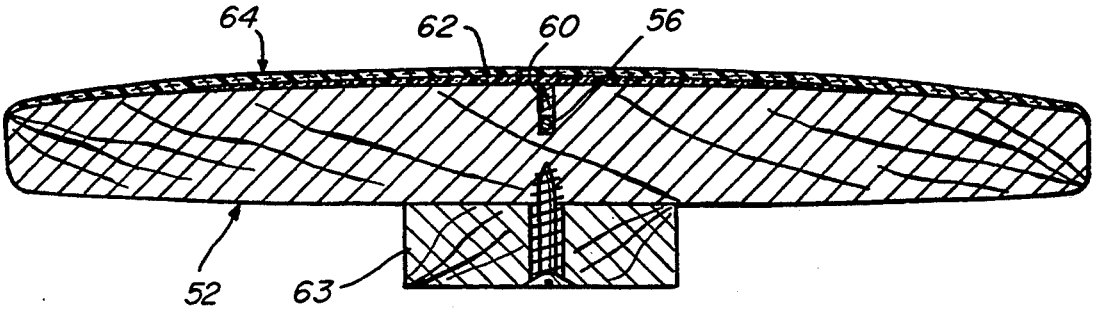
FIG. 13 is a cross-sectional view taken along line 13—13 of FIG. 12, basically through the body portion of the instrument.
Figure 14:
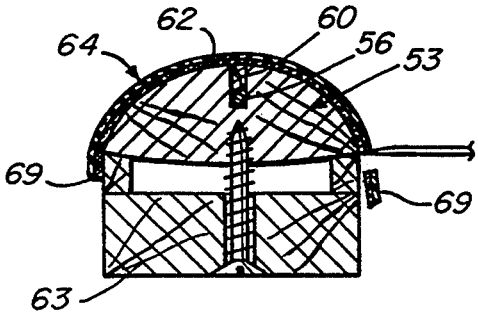
FIG. 14 is a cross-sectional view taken along line 14—14 of FIG. 12 and taken through the neck portion of the instrument.

Now, in FIG. 10 in addition to the wood core of the instrument, there is also illustrated multiple layers 62 of uni-directional carbon fiber. These layers of carbon fiber are impregnated with a high temperature epoxy resin. In FIG. 10 two layers of the carbon fiber are illustrated. In preparing the instrument for the lamination process, a support caul 63 is provided. The stiff caul screws to the fingerboard surface and extends to the body of the instrument. Refer also to FIGS. 13 and 14 to be described hereinafter.

Figure 11:
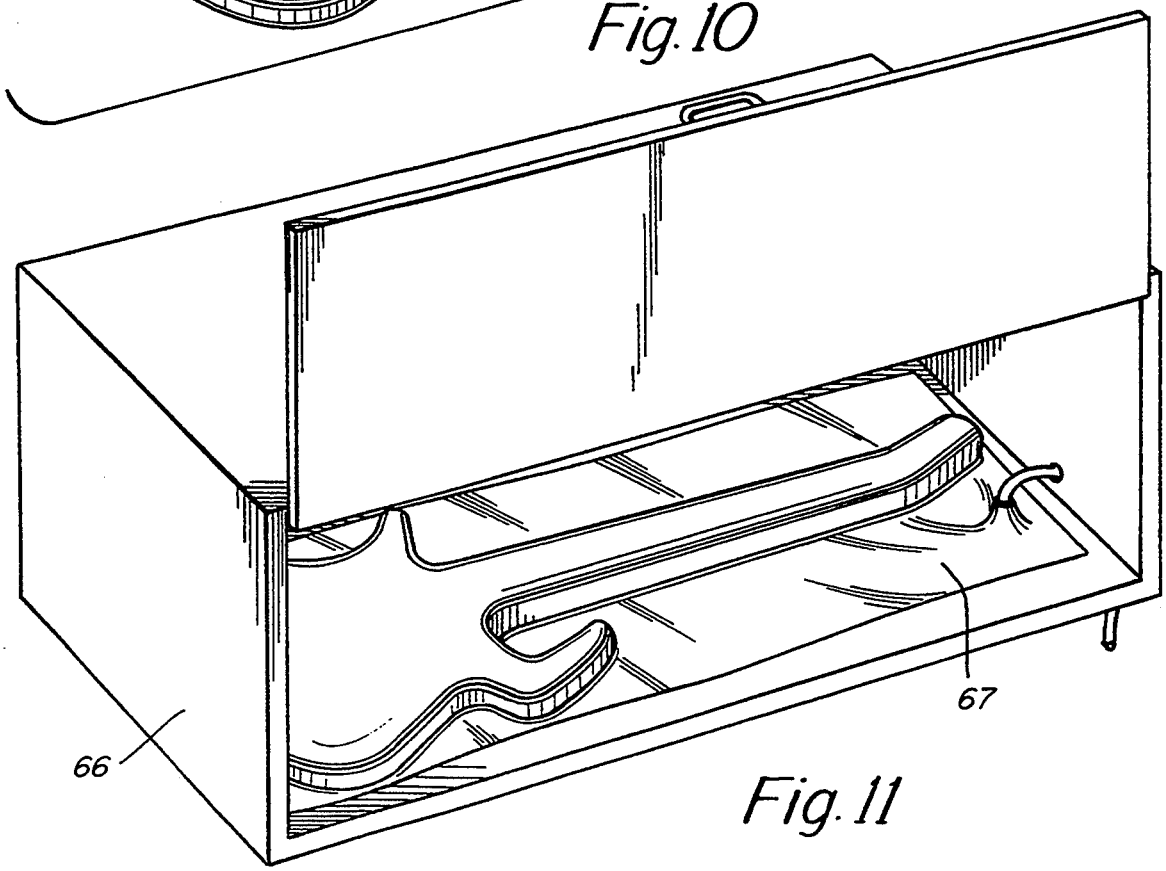
FIG. 11 is a perspective view illustrating one of the steps in the process of fabrication employing an oven and vacuum bag for heating and curing.
Figure 12:
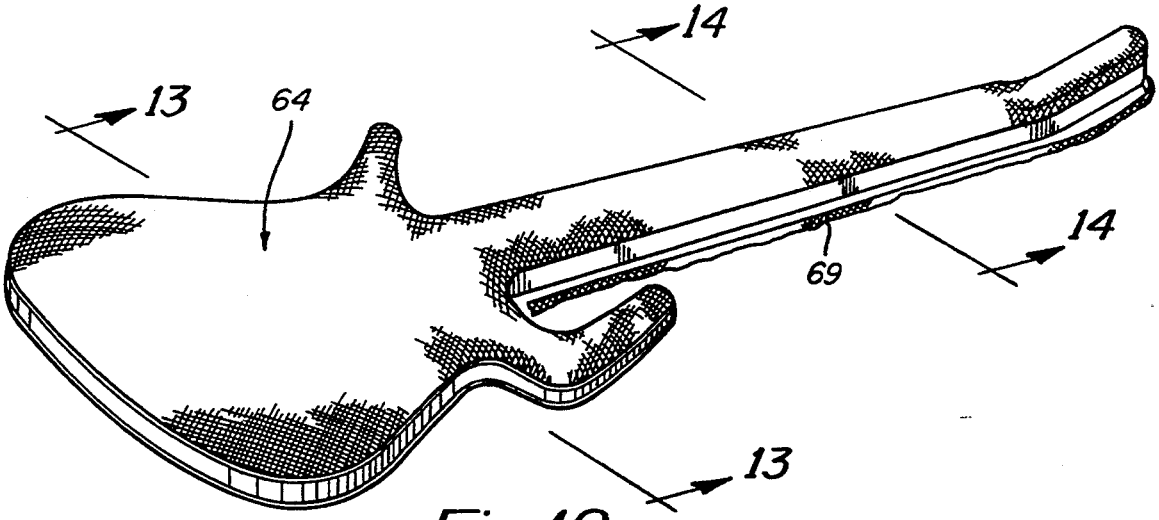
FIG. 12 is a perspective view of the guitar construction after the heating and curing step.

FIG. 11 also shows the fiberglass cloth layer 64. This is applied with a 45° bias as illustrated at 65. The layer 64 may be in the form of a fiberglass cloth. The 45° bias cut enables the fiberglass to better conform to the curves of the core. The layer 64 covers the back of both the body and the neck and can also covers the sides and front of the body as well. The fiberglass cloth is impregnated with a high temperature epoxy resin.

As indicated previously, the instrument is supported by a stiff caul. This supports the neck and headstock in their correct alignment and insures good playability. The stiff caul provides a place for the extra laminating material to go and prevents the undesirable condition of excess laminating material being bonded to the finger board surface. The caul is treated with a mold release, silicone material.

After the layers 62 and 64 have been impregnated they are pressed onto the instrument and the instrument is then ready for the curing of the laminate. In this regard, refer to FIG. 11 which shows an oven 66 for receiving the guitar. The guitar is disposed in a vacuum bag 67. This provides clamping pressure for the lamination. The curing occurs in an oven at a temperature of say 250° F. for a period of say two hours.

As indicated previously, the carbon fiber layers are preferably provided in multiple layers. Each of these layers may be 0.010 inch thick. This is uni-directional carbon fiber. The fiberglass cloth layer is bias cut as previously indicated and may have a thickness of 0.003 inch.

After the instrument has been cured the stiff caul is removed and excess material may be knifed off. The laminated edges are smoothed. The headstock and fingerboard surfaces are prepared. In this regard, refer to FIG. 12 herein which shows the instrument after having been cured. Sharp edges may be radiused by sanding. Excess material such as illustrated at 69 at FIG. 12 may be trimmed off.

Reference is now made to FIGS. 13 and 14 for cross sectional views through the guitar construction. FIG. 13 is taken through the body of the instrument while FIG. 14 is taken through the neck of the instrument. The both of these views are taken at an intermediate step in the fabrication of the guitar. It is noted in both FIGS. 13 and 14 that the caul 13 is still shown affixed to the wood core. FIGS. 13 and 14 also show the tension cable 56 and the filler piece 60. In the embodiment of FIGS. 13 and 14 the caul is secured to what will eventually be the front side of the guitar.

FIGS. 13 and 14 show the carbon fiber layer 62. This may preferably be feathered at the very edges as illustrated in FIG. 13. Over the carbon fiber layer there is provided the fiberglass layer 64. These same layers are also illustrated in FIG. 14. FIG. 14 also illustrates the excess laminate being trimmed at 69.

Figure 15:
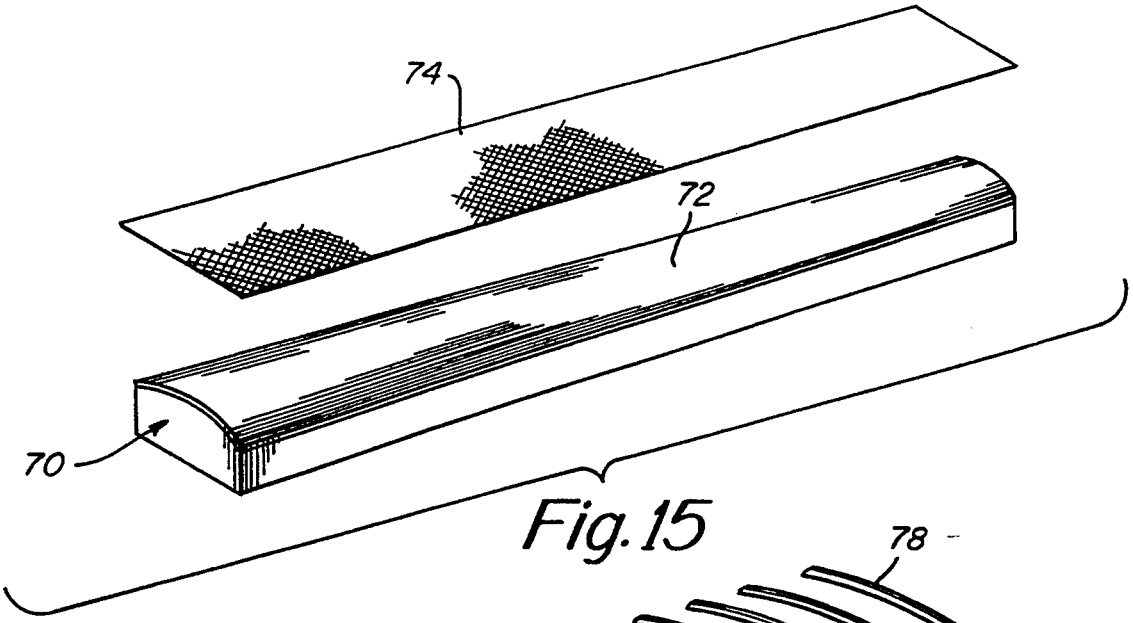
FIG. 15 is an exploded view showing an initial step in the fabrication of the fingerboard.
Figure 16:
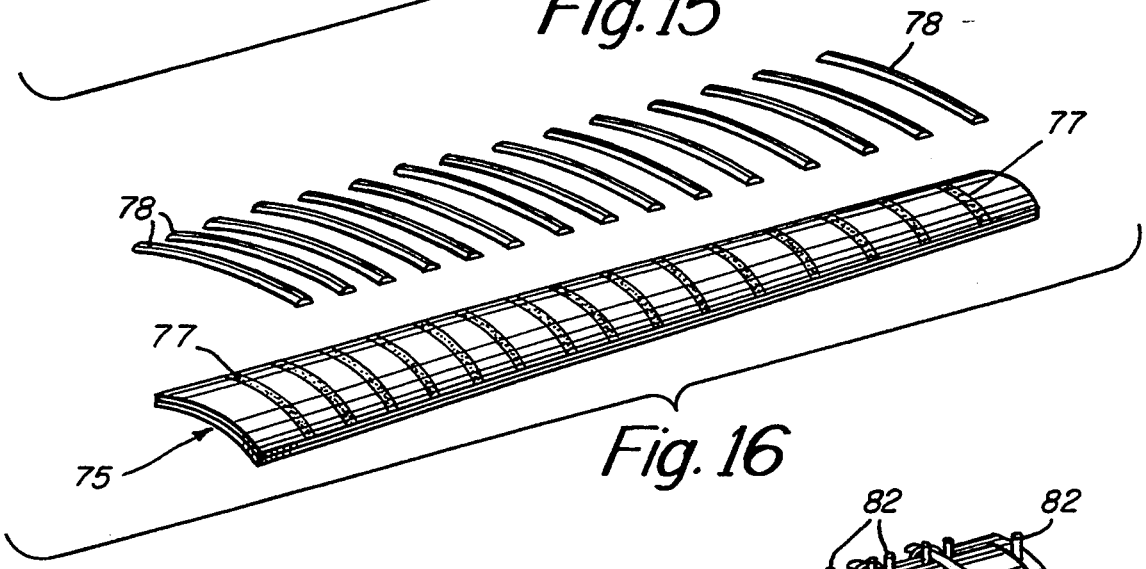
FIG. 16 is an exploded view showing a next step in the fabrication of the fingerboard.

Reference is now made to FIGS. 15–18 for further details in the construction, in particular, of the instrument fingerboard. In this regard, FIG. 15 shows a basic form 70 that is used to provide the proper contour for the fingerboard. On the top surface of the form 70 there may be provided a release material such as a gel that will enable the laminate components to be separated from the form. On top of the form there is shown a uni-directional carbon fiber layer 72. Disposed over the fiber carbon layer 72 is the bias cut fiberglass sheet 74. Both the layer 72 and the sheet 74 may be impregnated with a high temperature resin. The combination of the carbon fiber and the fiberglass on the form is then subjected to high temperature in an oven. The arrangement illustrated in FIG. 11 with the use of a vacuum bag may be employed for heating and curing so as to form the basic laminate as illustrated in FIG. 16 at 75.

FIG. 16 shows the laminate 75 after having been formed by heating and after having also been trimmed to the proper size for a particular instrument. On the top surface of the laminate 75 a mask is employed and the laminate is sandblasted using a mask to form the roughened strips 77 illustrated in FIG. 16. These are disposed at positions corresponding to positions where the frets are to be secured. In this connection, FIG. 16 also shows the frets 78 cut to the proper length and partially curved in form so as to substantially match the curvature of the laminate 75. The underside surface of the frets is also preferably sandblasted so as to be roughened. The frets may be cut from a length of stainless steel material of cross-section as illustrated in, for example, FIG. 23.

After having sandblasted both the frets and the laminate, epoxy adhesive is applied so as to enable the securing of the frets onto the laminate board.

Thus, in accordance with the present invention there is provided an extremely hard wire, preferably stainless steel fret construction that is tang-less.

Figure 17:
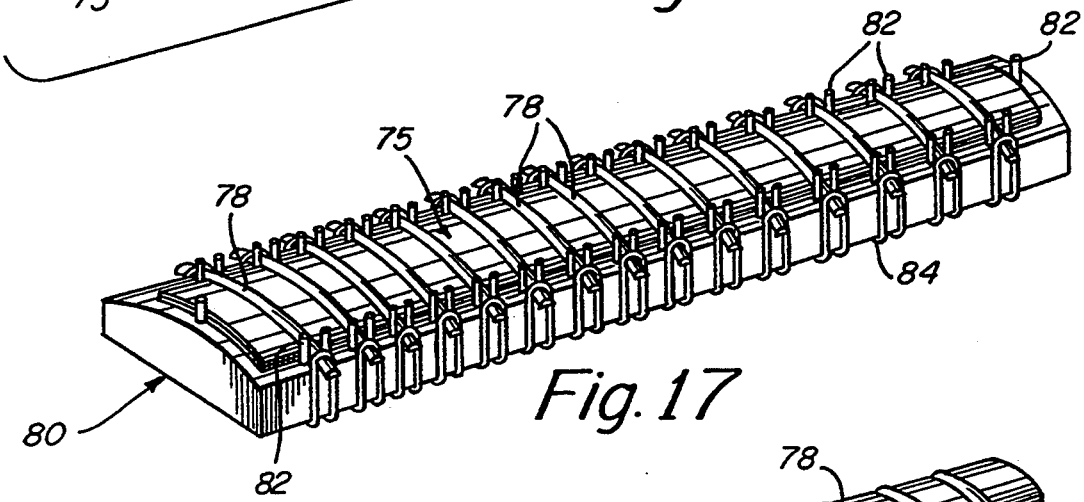
FIG. 17 is a perspective view illustrating still a further step in the fabrication of the fingerboard.
Figure 18:
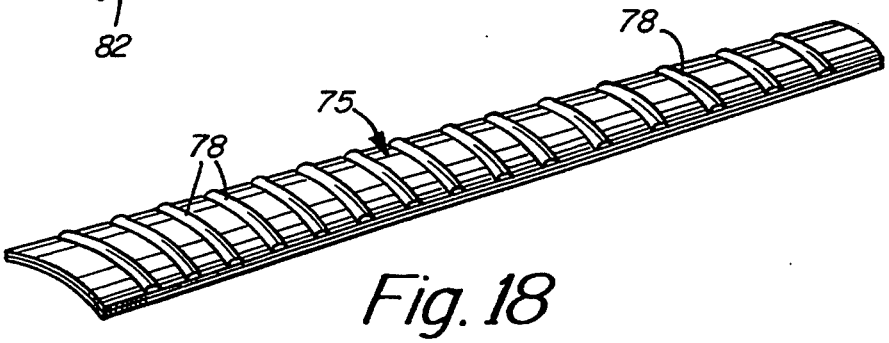
FIG. 18 is a perspective view illustrating the finished fingerboard construction.

Reference now made to FIG. 17 for a further step in the process of making the fret board. There is illustrated in FIG. 17 a fixture 80 having several locating pins 82. Two of these locating pins are disposed at opposite ends of the fixture 80 for positioning the laminate board longitudinally. The locating pins 82 also locate the individual frets 78. Rubber bands 84 are employed for holding the frets 78 securely against the laminate 75. With the laminate and frets in the position illustrated in FIG. 17, the assembly can then be baked. FIG. 18 shows the final fret board including the laminate with the individual frets attached thereto.

Figure 22:
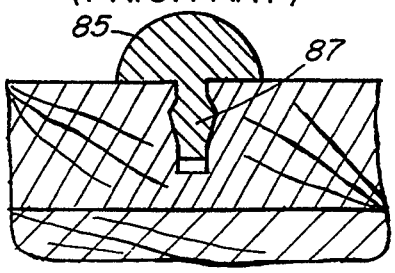
Fig. 22 (PRIOR ART)
FIG. 22 is a fragmentary cross-sectional view of a prior art fret construction.

Reference is now made to FIGS. 19–23 for further details of the fingerboard construction. FIG. 22 in particular shows a prior art tanged fret construction.

Before discussing the fret construction of the present invention in further detail, refer to FIG. 22. FIG. 22 shows a conventional fret 85 having a tang 87. These individual frets are constructed of a relatively soft material and have to be hammered into a slot in the fret board. After the fret has been inserted into the fret board it must then be reformed. The formation of a fret board in this manner is quite time consuming and costly and because a relatively soft metal is employed the fret board many times has to be reworked in the future.

On the other hand, in accordance with the present invention the fret board is constructed using frets of a hard metal, preferably a metal such as stainless steel. Rather than inserting these frets into a slot in the fret board, they are adhesively secured to the surface of the fret board. The fret construction of the present invention requires little or no reworking after the frets are applied.

Figure 19:
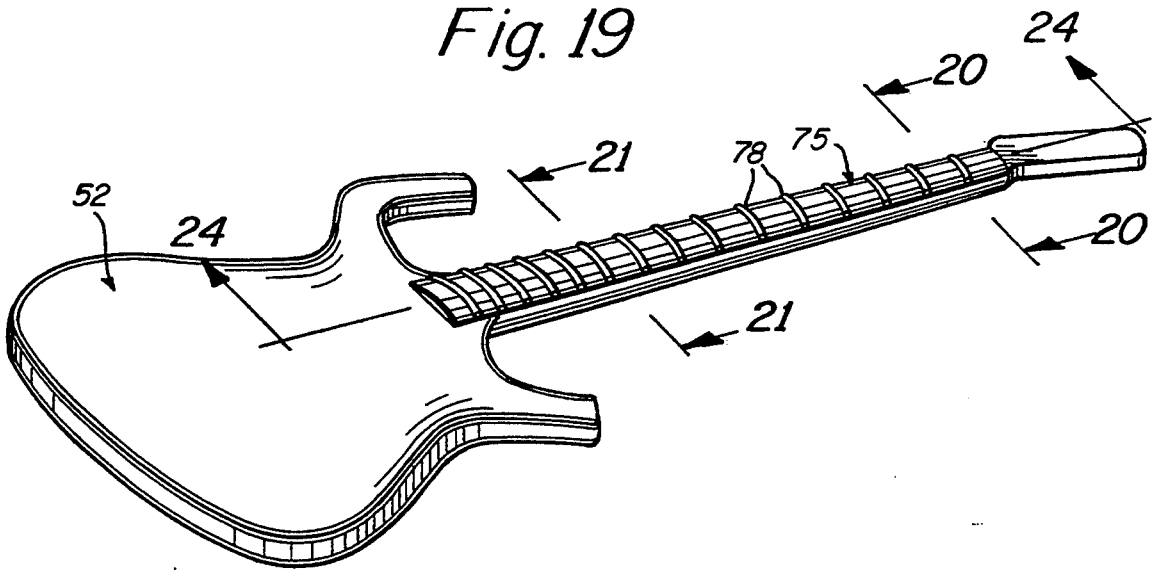
FIG. 19 is a perspective view illustrating the fingerboard having now been secured to the neck of the instrument.
Figure 20:
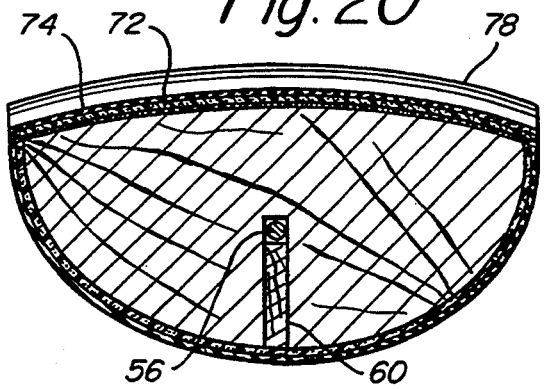
FIG. 20 is a cross-sectional view taken along line 20—20 of FIG. 19.
Figure 21:
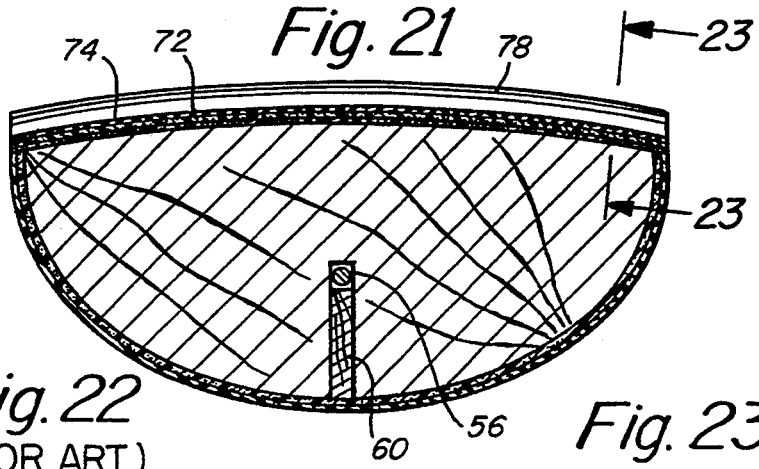
FIG. 21 is a cross-sectional view taken along line 21—21 of FIG. 19.

FIG. 19 is a perspective view showing the fingerboard attached to the guitar neck. The fingerboard may be secured to the instrument neck using, for example, a thin film adhesive. This may be provided in a relatively thin film on the order of 0.002 inch thick. Films of this type are preferred over the use of an applied liquid because the films are dimensionally stable and provide an accurate adhesive layer. One thin film adhesive that has been employed is a thermal plastic film adhesive that can be applied and provides sealing by application of heat. Also, one can employ an unsupported acrylic film adhesive. This does not require the application of heat. The adhesive that uses the application of heat may be preferred in that this will make it easier to remove and replace the fingerboard, simply by the application of heat.

Figure 23:
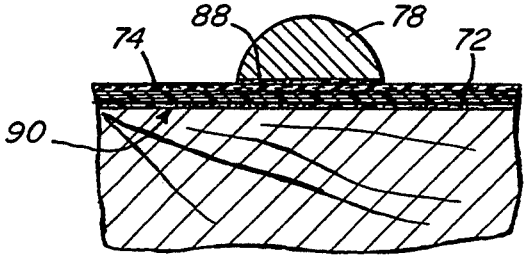
FIG. 23 is a cross-sectional view taken along line 23—23 of FIG. 21 showing the fret construction in accordance with the present invention.

Also, the frets 78 may be bonded to the fret board laminate itself using instead methylacrylate. In this regard, refer to FIG. 23 showing the methylacrylate layer 88 for securing the fret 78 to the laminate. Also, in FIG. 23 refer to the thin film adhesive 90 for bonding the fingerboard structure to the guitar neck.

For the securing of the frets on the fingerboard, a material such as methylacrylate is in particular advantageous. This is an anarobic adhesive in which the cross-linking occurs in the absence of oxygen. Thus, only the concealed adhesive will harden and any of the adhesive that is exposed to oxygen will not harded. This means that it will be easier to remove any excess adhesive with this particular technique.

Figure 24:
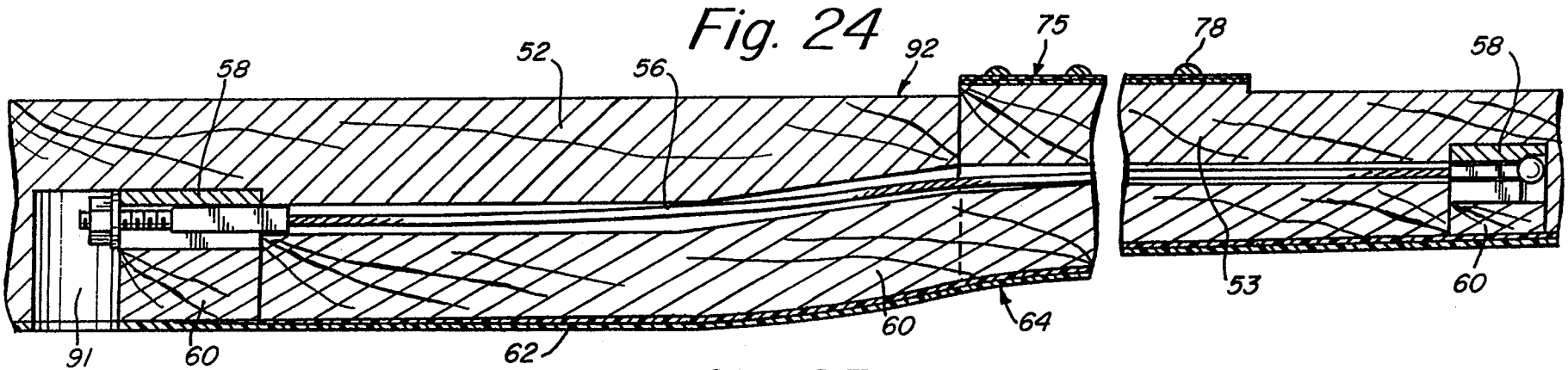
FIG. 24 is longitudinal cross-sectional view taken along line 24—24 of FIG. 19.
Figure 25:
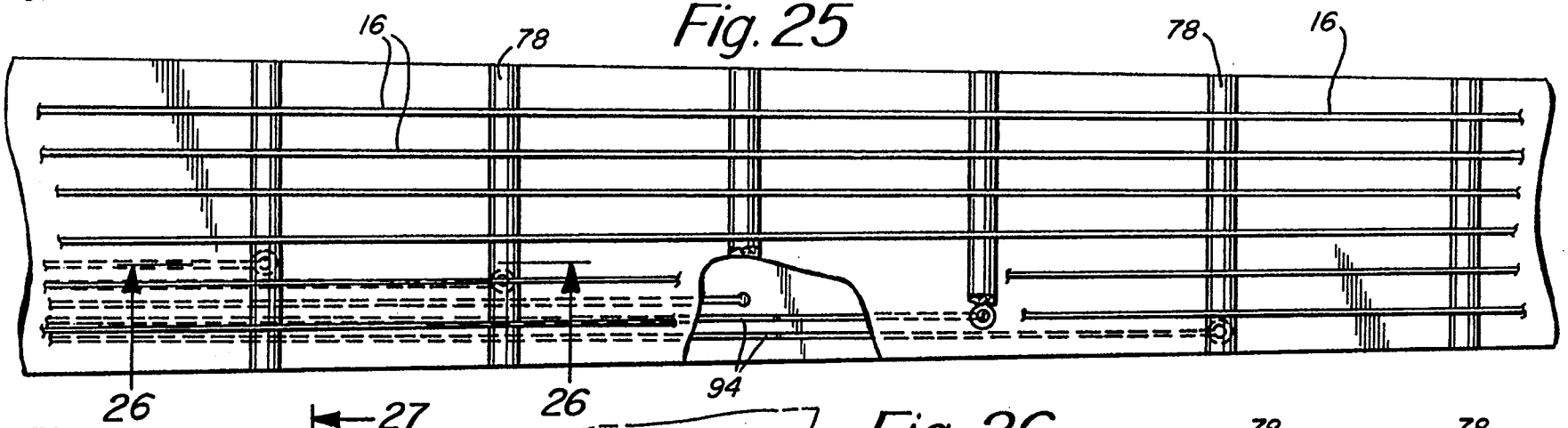
FIG. 25 is a plan view partially in cross-section of a portion of the fingerboard.

Reference is now made to FIG. 25 which is a longitudinal cross-sectional view taking along line 24—24 of FIG. 19. In FIG. 24 there is shown the tensioning cable 56 which may be a stainless steel cable that is adapted to flex around any corners or curves. The ends of the cable are supported by anti-rotation devices 58. There is also a tension adjusting nut accessible from the hole 91. A portion of the fingerboard 75 is shown with the frets 78. The top surface 92 can be painted or may also be coated with at least fiberglass and perhaps also the carbon fiber. With the use of at least fiberglass coat there is a harder surface provided.

FIG. 24 also shows the use of several wood filler strips 60. The underside surface is shown with its carbon fiber layer 62 and fiberglass layer 64. A heavy primer may be used to fill the rough surface of the fiberglass and then the instrument may be painted.

Figure 26:
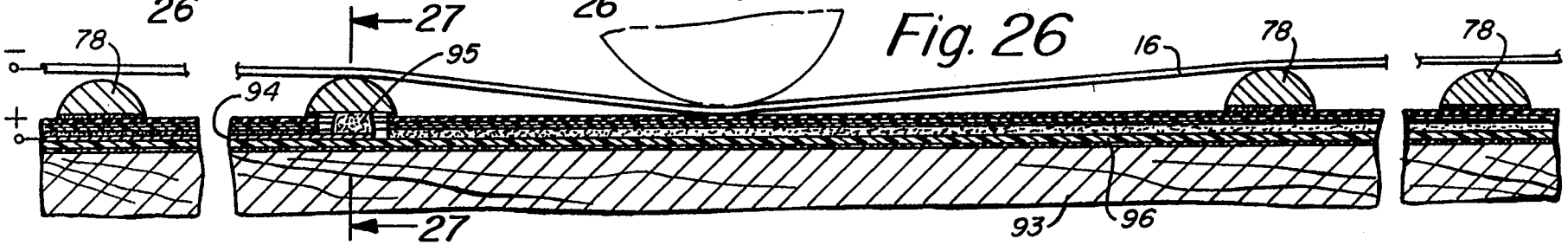
FIG. 26 is a more detailed cross-sectional view as taken along line 26—26 of FIG. 25.
Figure 27:
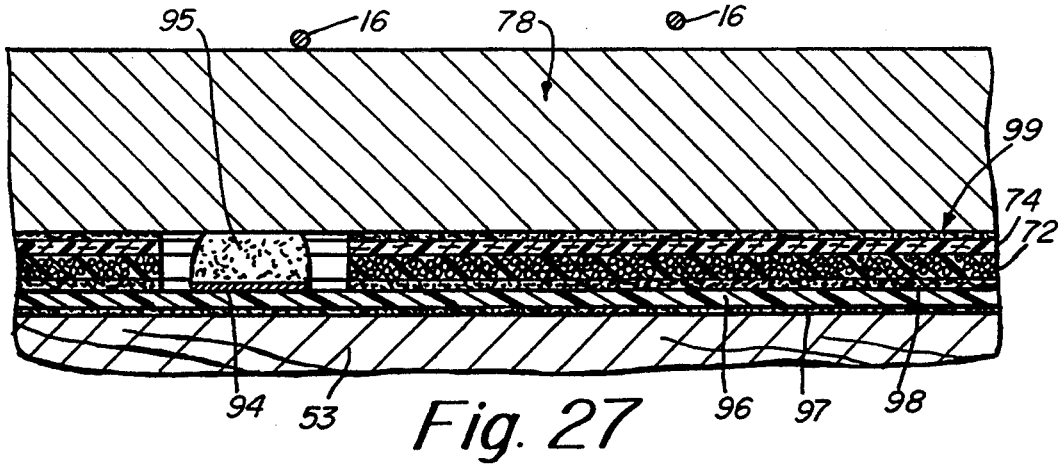
FIG. 27 is a further detailed cross-sectional view as taken along line 27—27 of FIG. 26.

References now made to FIGS. 25–27 for an alternate embodiment of the invention in which circuit runs are provided individually from each fret. When a fret is engaged with a finger such as shown in FIG. 26 then the conductivity between the string and the fret can be sensed by one of the circuit runs. Such a signal can be coupled by way of cable 30 to the electronic device 32. In this way, one can electronically sense the particular fret that is being engaged when in fact the string causes conductivity with the particular fret.

FIG. 25 shows the series of frets 78 as well as the strings 16 and furthermore shows the circuit runs at 94. As illustrated in FIG. 26, a conductive epoxy dab at 95 completes the electrical conductivity from the fret 78 to the circuit run 94.

In the embodiment of the invention illustrated in FIGS. 25–27, on top of the wood core there is directly provided a printed circuit board including the substrate 96. It is the dielectric substrate 96 that carries the circuit runs 94. A series of adhesives such as metal methylacrylate or an epoxy adhesive. For instance, an adhesive 97 as shown as referenced in FIG. 27 for securing the printed circuit board substrate. FIG. 27 also shows the circuit run 94 as well as the conductive epoxy dab 95.

FIGS. 26 and 27 also illustrate the carbon fiber layer 72 and the fiberglass sheet layer 74. A non-conductive epoxy layer 98 is employed over the substrate so as to isolate the circuit runs. Also, there is an epoxy layer 99 or alternatively a methylacrylate adhesive for securing the frets, as previously described.

Having now described a number of embodiments of the present invention, it should now be apparent to those skilled in the art that numerous other embodiments and modifications thereof are contemplated as falling within the scope of the present invention as defined by the appended claims.

What is claimed is:

1. A method of constructing a fret board of a stringed musical instrument comprising the steps of:

providing a laminate of a carbon fiber layer and a fiberglass layer, forming the laminate into a laminate board to form a fret board surface, providing a plurality of separate hard metal frets, each having a generally flat bottom surface, positioning the frets on the fret board surface so that the bottom of each fret is against the fret board surface, and adhesively securing the frets to the laminate board.

2. A method as set forth in claim 1 wherein both the laminate board and frets have an arched surface.

3. A method as set forth in claim 2 further comprising the step of providing roughened surface strips over the fret board surface prior to the step of adhesively securing.

4. The method as forth in claim 1, further comprising the step of impregnating the carbon fiber layer and fiberglass layer with a high temperature resin.

5. The method as set forth in claim 4, further comprising the step of subjecting the carbon fiber layer and fiberglass layer to high temperature so that a rigid laminate board is formed.

6. The method of claim 5, further comprising subjecting said carbon fiber layer and fiberglass layer to a vacuum.

7. The method of claim 1 wherein the step of adhesively securing comprises providing an anarobic adhesive to portions of the laminate board, and providing a force onto the frets positioned on the fret board surface.

8. A method of constructing a fret board of a stringed musical instrument comprising the steps of:

providing a multi-layer laminate as a fret board having a fret board surface;

positioning a plurality of metal frets, each having a generally semi-circular cross-section on the fret board surface; and securing the frets to the fret board surface.

9. The method of claim 8 wherein the step of providing a multi-layer laminate comprises providing a laminate of a carbon fiber strengthening layer and a fiberglass finish layer.

10. The method of claim 8 wherein the step of securing comprises securing with an adhesive.

11. The method of claim 10 wherein the adhesive is anarobic.

12. A fret board of a stringed musical instrument comprising:

a multi-layer laminate fret board having a fret board surface; and a plurality of tangless frets, each having a generally semi-circular cross-section with a circular portion and a diameter portion, the frets positioned and secured so that the diameter portion extends across the fret board surface.

13. The fret board of claim 12 wherein the multi-layer laminate includes a carbon fiber strengthening layer, and a fiberglass finish layer.

14. The fret board of claim 13 wherein the multi-layer laminate comprises multiple carbon fiber layers.

15. The fret board of claim 12 further comprising an adhesive between the frets and the laminate.

16. The fret board of claim 12 wherein the frets comprise a hard metal.

17. A method of constructing a fret board of a stringed musical instrument comprising the steps of:

providing a multi-layer laminate;

forming the laminate into a laminate board with a fret board surface having a width;

providing an adhesive in strips along the width of the fret board surface;

positioning a plurality of tangless frets on the fret board surface, the frets having a length greater than the width of the fret board, and having ends overhanging the fret board surface;

providing a biasing force to the ends of the frets so that the frets conform to the shape of the fret board surface and are biased against the adhesive strips; and cutting the ends of the frets so that the length of the frets is similar to the width of the fret board.

18. The method of claim 17 wherein the step of positioning comprises a positioning a plurality of hard metal tangless frets.

* * * * *